United States Patent [19]

Spector

[11] 4,099,713

[45] Jul. 11, 1978

[54] ELECTRONIC PHYSICAL TRAINER SYSTEM

[76] Inventor: Donald Spector, 380 Mountain Rd., Union City, N.J. 07087

[21] Appl. No.: 816,255

[22] Filed: Jul. 15, 1977

[51] Int. Cl.[2] ..... A63B 21/00; G01L 5/00; G08B 7/00

[52] U.S. Cl. ..... 272/93; 73/379; 272/DIG. 5; 340/323 R; 340/384 E

[58] Field of Search ..... 272/67, 72, 73–75, 272/93, 99, 100, 109, 112, 114, 116, 120, 129, DIGS.4–6; 73/379; 35/29 R, 29 E; 340/323 R, 331, 332, 384 R, 384 E; 273/86 B

[56] References Cited

U.S. PATENT DOCUMENTS

| | | | |
|---|---|---|---|
| 2,940,312 | 6/1960 | Smith et al. | 73/379 |
| 3,403,908 | 10/1968 | Sheldon et al. | 273/86 B |
| 3,511,097 | 5/1970 | Corwin | 73/379 |
| 3,744,480 | 7/1973 | Gause et al. | 272/DIG. 6 |
| 3,797,010 | 3/1974 | Adler et al. | 340/323 R |
| 3,834,702 | 9/1974 | Bliss | 272/100 X |
| 3,845,756 | 11/1974 | Olsson | 272/DIG. 6 |
| 3,846,704 | 11/1974 | Bessette | 35/29 R X |
| 3,995,492 | 12/1976 | Clynes | 272/DIG. 5 |

FOREIGN PATENT DOCUMENTS

| | | | |
|---|---|---|---|
| 2,433,121 | 1/1976 | Fed. Rep. of Germany | 35/29 R |
| 1,083,705 | 9/1967 | United Kingdom | 272/DIG. 5 |
| 467,745 | 8/1975 | U.S.S.R. | 272/100 |

*Primary Examiner*—Richard C. Pinkham
*Assistant Examiner*—Vance Y. Hum
*Attorney, Agent, or Firm*—Michael Ebert

[57] ABSTRACT

An electronic physical trainer system which produces periodic tone signals at an adjustable rate to establish an exercise rhythm and which senses the calisthenic activity of a performer in response to this rhythm to evaluate and improve his performance. The trainer system includes a position sensor in the form of a light beam directed toward a photodetector in a path traversing an exercise area to produce action pulses which reflect the movement of the performer as he alternately blocks and clears the beam path. Also included in the system is a pulse generator whose frequency is adjustable to produce exercise pulses which activate a tone generator whose output is amplified and reproduced to provide the tone signals. The exercise pulses and the action pulses are compared in a coincidence network which yields a "hit" pulse each time an action pulse overlaps an exercise pulse to a degree exceeding a set value and which otherwise yields a "miss" pulse. The hit and miss pulses are separately counted and displayed to score the performance.

11 Claims, 3 Drawing Figures

ELECTRONIC PHYSICAL TRAINER SYSTEM

BACKGROUND OF THE INVENTION

This invention relates generally to physical training aids, and more particularly to an electronic physical trainer system which produces periodic tone signals at an adjustable rate to establish an exercise rhythm and which senses the calisthenic activity of a performer in response to these signals to evaluate and improve his performance.

The distinction between exercise and physical education or training is that exercise acts to enhance muscle tone and to cause the blood to circulate more efficiently so that waste matter from the tissues can be eliminated more effectively and the tissues can better repair themselves, whereas physical training involves some form of calisthenic activity carried out in a rhythmic pattern so that the beneficial effects of muscular exertion are accompanied by improved body coordination and physical grace.

Lack of exercise leads to flabbisness and even maldevelopment of muscle and bone. In the United States, the opportunity to exercise the muscles in day-to-day living has become so limited among large sections of the population that there is a growing concern with the problem of obesity and ailments resulting from overweight.

One popular exercise in physical training is jumping jacks, a conditioning exercise performed from a standing position by jumping to a position with legs spread apart and hands touching overhead, and then back to the original position. In a gymnasium, a physical training instructor usually calls out the rhythm for this exercise. At the outset, the instructor's rhythm is slow and as the exercise progresses, the beat is gradually increased. The performer is evaluated by his ability to keep up with the changing rhythm.

Skip rope exercise is also beneficial but in this instance the performer sets his own rhythm. In skip rope, the performer holds the ends of a rope in his hands and creates a hoop by centrifical force which he rotates in a circular orbit about his body. To avoid intercepting the rotating hoop, the performer must leap upwardly just before the hoop reaches his feet and he must coordinate the rate of hoop rotation with his jumps. Once this coordination is lost, the hoop strikes the feet and collapses.

In other forms of conditioning exercise such as push-ups, it is not the feet which are periodically raised about the ground, but the torso or some other part of the body. Thus most physical training exercises involve the raising of a body part above the ground at a rhythmic rate controlled by an instructor or by the performer himself.

When a performer wishes to exercise by himself at home, he is often faced with a practical situation which militates against effective conditioning. Thus in the case of skip rope exercises, the home environment may be such that there is insufficient room for a rotating rope hoop. Moreover, the rope constitutes a hazard in that it may intercept and damage fragile articles.

But even in the case of exercises that require no rope or other equipment, in the absence of a trainer or instructor the exerciser must set up the rhythm and also make his own evaluation. This does not lead to satisfactory results, for a self-regulating performer lacks the necessary objectivity for effective conditioning. It is only by independent evaluation that a performer can be motivated to improve his performance.

SUMMARY OF INVENTION

In view of the foregoing it is the main object of this invention to provide an electronic physical trainer (EPT) system that produces periodic tone signals to establish an exercise rhythm and which senses the calisthenic activity of a performer in response to the signals to evaluate and improve his performance.

More particularly, it is an object of this invention to provide an EPT system which generates exercise pulses to produce periodic tone signals and which detects the position of the performer's feet or other moving body member within a restricted exercise area to develop action pulses as the member goes from one position to another, the exercise pulses and the action pulses being compared to evaluate the performer's ability to remain in step with the tone signals.

Yet another object of this invention is to provide an EPT system which not only counts the number of times the performer is in step with the sound signals but also the number of times he is out of step and which separately displays these counts to afford a reading from which the performance may be scored.

One problem with conventional physical training exercises is that of boredom, for if the exercise is unvaried, the performer loses interest in continuing to repeat the same calisthenic sequence. Such boredom, is normally avoided by a physical training instructor who in the course of a given regimen will increase the rhythm rate and thereby introduce a challenge which maintains the performer's interest. A significant feature of the present invention is that the repetition rate of the periodic tone signals may be varied in the course of an exercise regimen or from one exercise cycle to the next.

Another advantageous aspect of an EPT system in accordance with the invention is that it not only determines whether the action pulses produced by the performer are in step with the exercise pulses but also the phase relationship or degree of overlap therebetween, so that if the phase displacement is such that the action pulses are almost but not quite out of step, they may then be scored as misses, not as hits. The degree of phase displacement which constitutes a miss can be varied and hence represents a "difficulty" adjustment. Thus the set poingt of the EPT system may be set so that unless an action pulse is closely in step with an exercise pulse, it is treated as a miss — or the system may be more liberally adjusted so that as long as there is even a small overlap between an action and an exercise pulse it is treated as a hit.

Briefly stated these objects are attained in an EPT system including a position sensor constituted by a light source that directs a beam in a path traversing a restricted exercise area toward a photodetector whereby as a performer in this area repeatedly raises both his feet or some body member above ground to an extent clearing the beam and he then returns his feet to ground to block the beam, the detector output takes the form of action pulses which reflect this repetitive activity.

The sensor is not limited to exercises such as skip rope in which both feet must be simultaneously above ground. Thus in the case of a jogging exercise in which the feet of the performer are alternately raised above ground, the beam may be directed toward one of the two feet so that as this foot pumps up and down, action pulses are produced.

Also included in the system is a pulse generator whose frequency is adjustable to produce exercise or pacing pulses at a desired rate which may be varied in the course of an exercise regimen. The exercise pulses activate a tone generator whose output is amplified and reproduced to produce tone signals establishing an exercise rhythm. The calisthenic activity of the performer in response to the exercise pulses is reflected by the action pulses and these pulses are compared in a coincidence network with the exercise pulses.

The coincidence network yields a hit pulse each time the overlap between an action pulse and an exercise pulse exceeds a predetermined phase displacement or set point and a miss pulse for all other displacements. If, for example, the feet of the performer is raised to unblock the beam at a point in time subsequent to the trailing edge of the exercise pulse, this being indicative of the fact that the performer is altogether out of step, then a "miss" pulse will be registered. But if this point in time which represents the leading edge of the action pulse coincides with any point within the exercise pulse, then a "hit" pulse will be registered. On the other hand, one can adjust the coincidence network so that unless the point in time of the action pulse at least coincides with the midway or some other set point in the exercise pulse, a miss pulse will be registered.

The hit and miss pulses are separately counted and these counts are displayed to provide a reading of the performance. Preferably a single digital display device serves selectively to afford a reading of hits and misses.

OUTLINE OF DRAWING

For a better understanding of the invention as well as other objects and further features thereof, reference is made to the following detailed description to be read in conjunction with the accompanying drawings, wherein:

FIG. 1 schematically illustrates an EPT system in accordance with the invention;

DESCRIPTION OF THE INVENTION

Figure 1:
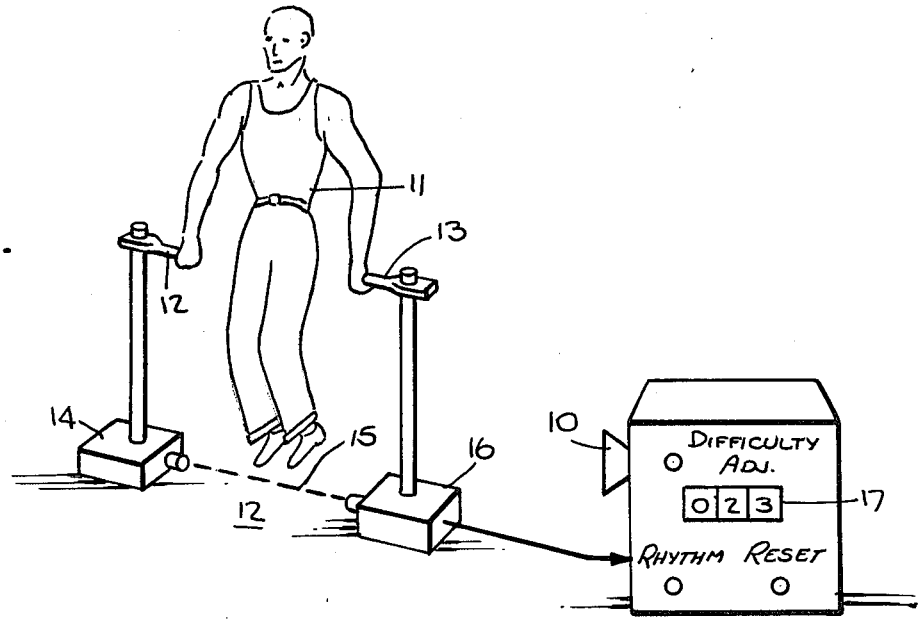

The System:

Referring now to FIG. 1, there is shown an EPT system in accordance with the invention adapted to generate periodic tone siganals that are reproduced by a loud speaker 10 to establish an exercise or pacing rhythm for a performer 11.

By way of example, we shall assume that the system is to function as a skip rope simulator whereby performer 11 proceeds to jump up and down within a restricted area 12, just as if he were to do so to escape a hoop rotating about his body. In this instance, the periodic tone signals from speaker 10 represents those points in time when the imaginary hoop is about to strike the feet of the performer. The performer must therefore, in synchronism with the tone signals, jump upwardly to avoid being struck by the hoop. Should the performer succeed in jumping in synchronism with the tone signals, then he effectively is skipping rope.

To further aid in simulating a skip rope exercise, a pair of handles 12 and 13 may be pivotally mounted on standards at an appropriate level above ground which may be adjustable. These handles are grasped by the performer as if he were holding onto the ends of a rope. Positioned on one side of exercise area 12 is a light projector 14 adapted to direct a beam 15 across this area toward a photodetector 16. When the performer's feet are on the ground they intercept the beam and block the flow of light to detector 16. When the performer leaps upwardly the feet clear the beam and the detector in response to the light impinging thereon produces an output voltage.

Thus as the performer jumps up and down more or less in synchronism with the periodic tone signals, detector 16 yields periodic action pulses which reflect this calisthenic activity. The tone signals emitted by loud speaker 10 are derived from a tone generator which is activated by exercise pulses produced by a pulse generator. The frequency of the pulse generator is adjustable so that the rhythm can be made slow or fast, as desired, or as will be explained later, the repetition rate of the exercise pulses may be advanced in the course of an exercise regimen to make the exercise progressively more difficult and challenging.

The action pulses derived from photodetector 10 are compared with the exercise pulses from the pulse generator in a coincidence network, to be later described, to determine their degree of coincidence. In its simplest embodiment, the EPT system may be operated so that as long as a particular action pulse overlaps to any extent a corresponding exercise pulse, this condition is treated as a "hit," whereas when an action pulse is out of phase with an exercise pulse it is treated as a "miss."

The hits and misses are represented by pulses yielded by the coincidence circuit and these are applied to separate pulse counters. After the performer has completed his exercise regimen which may last say 10 minutes, the respective counts registered in the counters are presented on a digital display device 17 which in practice may be an LED display.

While it is possible to provide separate LED display stations for hits and misses, it is less expensive to use a single display, and for this purpose a manually operated gate is provided to selectively feed the counts from the miss and hit counters to the display device.

Such scoring makes it possible for the performer to evaluate and improve his performance. Thus assuming that an exercise regimen lasts 10 minutes during which 400 exercise pulses are generated, and the display indicates 342 hits and 58 misses, this performance deserves a "good" grade, but if the display indicates a score of 396 hits and 4 misses, then the performer is entitled to an "excellent" rating. This grading serves to inspire the performer toward greater effort in attaining a higher grade. It may also be used for competition between two or more performers.

The system is arranged to announce misses through the same speaker which emits the exercise tone signals, a miss being represented by a buzzer-like sound or other penetrating tone which is readily distinguishable for a pacing tone. In this way the performer is immediately made aware that he has fallen out of step and he can then take corrective measures.

It will be appreciated that visible rather than tone signals may be used to establish the rhythm, or one may employ a combination of light and sound for this purpose. In practice the system may be arranged to delay counting after a reset to zero until after say the fifth tone signal to that the performer is given a brief warm-up period in which to fall into step with the pacing tones.

Figure 2:
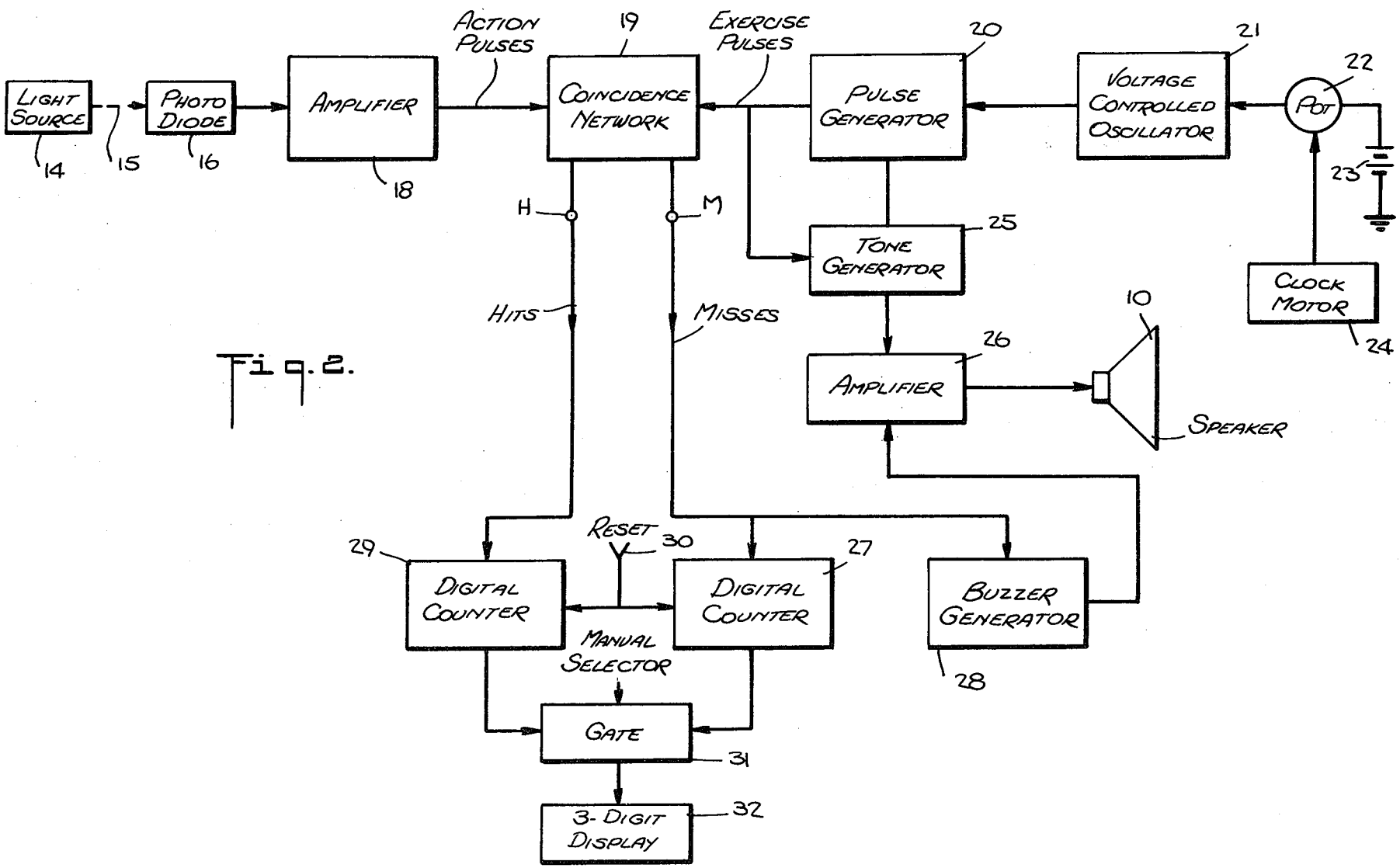
FIG. 2 is a block diagram of the circuit arrangement of the system.

The Circuit:

Referring now to FIG. 2, the circuit arrangement of the EPT system is shown. It will be seen that the output of detector 16 which picks up light beam 15 from projector 14 is applied to an amplifier 18 whose action pulse output is applied to one input of a coincidence network 19. In practice, detector 10 may be a photodiode and the light projector 14 a strobe light source.

Applied to the other input of coincidence network 19 is the exercise pulse output of a pulse generator 20 which, in practice, may be a Schmidt trigger. Pulse generator 20 is activated by a voltage-controlled oscillator 21 (VCO) whose operating frequency is adjusted by a potentiometer 22 coupled to a D-C voltage source 23, the greater the voltage applied to the VCO, the higher its operating frequency.

Thus, if the oscillator frequency is 3 Hz, the exercise pulse from generator 20 is then 3 pulses per second. Potentiometer 22 which varies the exercise pulse frequency may be manually adjusted, or it may be operated by a clock motor 24 such that during an exercise regimen lasting say 10 minutes, the motor slowly rotates the potentiometer to gradually increase the exercise pulse rate. In this way, the pacing may be slow at the outset of the exercise and progressively sped up. Or the speed-up may be effected in discrete steps, by a step motor rather than continuously.

The output of pulse generator 20 is also applied to a normally quiescent tone generator 25 whose output is applied through an amplifier 26 to speaker 10. Tone generators produce a distinctive and pleasing tone, say, a 1200 Hz tone or beep each time it is activated by an exercise pulse from generator 20. These tones are reproduced by speaker 10.

In practice, rather than maintaining an unchanged tonal pitch, the pitch may be raised as the exercise rhythm becomes faster so as to make the performer aware that the rhythm is speeding up. This can be done by integrating the pulses from the pulse generator 20 to produce an analog voltage whose magnitude depends on the pulse rate and applying this analog voltage to a voltage-controlled oscillator functioning as tone generator 20. In this way, the pulse generator not only activates the tone generator but it also determines by the rate of activation the tone produced.

Thus for an exercise rhythm of one per second, the tone frequency can then be 1000 Hz, for a rhythm of two per second; the tone frequency can be 1500 Hz, for three per second, 2000 Hz and so on. Psychologically, one relates pitch to the intensity of a given activity and a higher pitch accompanying a higher exercise rate tends to incite the performer to heightened effort.

Figure 3:
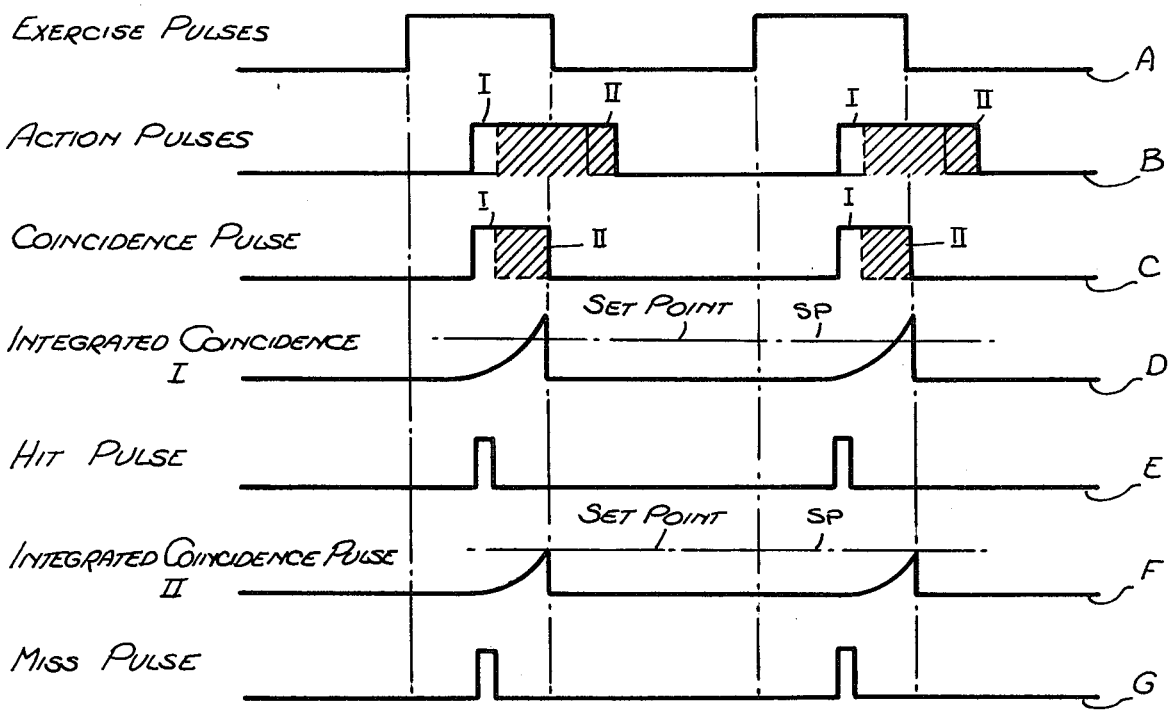
FIG. 3 illustrates pulse waves produced at various points in the circuit.

Thus applied to coincidence network 20 are rectangular exercise pulses from pulse generator 20, as indicated on line A of FIG. 3 as well as action pulses derived from the position sensor, as shown on line B in FIG. 3. The phase relationship between action pulses B and exercise pulses A depends on the extent to which the performer is in step with the rhythm. If the performer's feet are always on the ground each time he hears a tone signal, then he will be altogether out of step. The action pulses will then be out of phase with the exercise pulses and there will be no overlap at all in time between these pulses.

FIG. 3B shows action pulses B which have some degree of overlap with exercise pulses A, two conditions I and II being represented on line B. Condition I indicates a high degree of overlap, for here the leading edge of the action pulses is about at the midpoint of the exercise pulses, whereas Condition II indicates a lesser degree of overlap.

The coincidence pulses produced in coincidence network 19, as indicated in line C of FIG. 3, have a duration that corresponds to the extent of overlap between the action and exercise pulses. Hence, coincidence pulses I derived from action pulses I are broader than coincidence pulses II derived from action pulses II. Coincidence network 19 includes a coincidence gate to which the action and exercise pulses are applied, the gate yielding the coincidence pulses (shown in line 3C.

These coincidence pulses are applied to an integrator to produce integrated coincidence pulses. For the broader coincidence pulses I, the resultant integrated coincidence pulses, as shown in FIG. 3D, exceed a predetermined set point represented by dashed line SP in a level detector which yields hit pulses, as shown in line E. But for the shorter coincidence pulses II, the resultant integrated coincidence pulses, as shown in line F, fall below set point level SP, and the level detector then yields in a separate output the miss pulses shown in line G.

Thus coincidence network 19, which includes the integrator and the level detector, yields at output H "Hit" pulses when the degree of overlap between the action and exercise pulses is sufficiently high to exceed a predetermined set point, and it yields at output M "Miss" pulses when there is no overlap or the degree of overlap falls below the set point. The set point is adjustable, and the knob for this purpose constitutes a "Difficulty" adjustment; for the higher the set point, the more difficult it is to score a hit.

The Miss pulses from output M are applied to a digital counter 27 and also to a buzzer tone generator 28. Generator 28 is activated by each Miss pulse to produce a distinctive rasping tone that is applied to amplifier 26 and reproduced by speaker 10 so that the performer is immediately made aware of his misstep.

The Hit pulses from output H are applied to a digital counter 29. Both counters 27 and 29 may be simultaneously reset to zero by a manual reset button 30. Upon the completion of an exercise regimen, the counts held in counters 27 and 29 are applied through a gate 31 to a 3 digit display device 32 which is so arranged that when a button is depressed and the read-out shifts from the Hit counter to the Miss counter. In this way, the performer, upon the completion of an exercise regimen, obtains a score of his performance. In lieu of electronic counters operating in conjunction with an electronic display, electromechanical register may be used to count and display the hits and misses.

While there has been shown and described a preferred embodiment of an electronic physical trainer system in accordance with the invention, it will be appreciated that many changes and modifications may be made therein without, however, departing from the essential spirit thereof. For example, one may provide a predetermined delay between the tone signal and the exercise pulse such that the performer is signalled to jump at the instant he hears the tone, rather than in anticipation of the tone. In other words, the tone signal represents, in the case of a skip rope simulator, a given position of the rope hoop relative to ground, and this position in space can be adjusted by a variable delay.

Also, instead of a position sensor in which a light projector is used which is separate from the photodetector, one may use a light projector in the same housing as the detector, the beam from the projector being picked up by a separate reflector on the other side of the exercise area and redirected toward the detector.

I claim:

1. An electronic physical trainer system comprising:

A. means to generate periodic exercise pulses to establish an exercise rhythm;

B. means responsive to said exercise pulses to produce corresponding tone signals to pace a performer;

C. a position sensor constituted by means projecting a light beam across an exercise area toward a detector to produce action pulses which reflect the movement of the performer as he alternately blocks and clears the beam in seeking to synchronize his movement with that of the tone signals;

D. means to compare the exercise pulses with the action pulses to produce a hit pulse each time an action pulse overlaps an exercise pulse and to produce a miss pulse in the absence of an overlap;

E. means to separately count the hit and miss pulses during a given exercise regimen; and F. means to display the respective hit and miss counts to score the performance.

2. A system as set forth in claim 1, including means to adjust the repetition rate of said exercise pulse generator means to vary said rhythm.

3. A system as set forth in claim 2, wherein said exercise pulse generator means is constituted by a voltage-controlled oscillator whose output is applied to another pulse generator to produce pulses at a repetition rate corresponding to the frequency of the oscillator, and said adjusting means applies a varying voltage to said oscillator to adjust the frequency thereof.

4. A system as set forth in claim 3, wherein said voltage varying means includes a potentiometer.

5. A system as set forth in claim 4, further including a clock motor to operate said potentiometer to gradually increase said voltage in the course of said regimen.

6. A trainer as set forth in claim 3, wherein said tone signals are produced by a tone generator coupled to a loudspeaker and activated by said exercise pulse generator.

7. A trainer as set forth in claim 6, wherein said miss pulses are also applied to a buzzer tone generator to activate same to produce a buzzer tone which is reproduced by said speaker.

8. A trainer as set forth in claim 1, wherein said display means is a single digital display device and includes means which selectively presents either the miss count or the hit count.

9. A trainer as set forth in claim 1, wherein said means to compare the exercise and action pulses is constituted by a coincidence network.

10. A trainer as set forth in claim 9, wherein said network includes a coincidence gate to produce coincidence pulses whose width depends on the degree of coincidence between the action and exercise pulses, and means to integrate the coincidence pulses to produce integrated pulses from which one determines that degree of overlap that constitutes a hit.

11. A trainer as set forth in claim 1, further including means to simultaneously reset both counters.

* * * * *